US012736251B2

(12) United States Patent
Kim et al.

(10) Patent No.: US 12,736,251 B2
(45) Date of Patent: Sep. 15, 2026

(54) AIR PURIFIER

(71) Applicant: LG ELECTRONICS INC., Seoul (KR)

(72) Inventors: Bohyun Kim, Seoul (KR); Juhyup Yoon, Seoul (KR); Taesan Kim, Seoul (KR); Dongeun Kim, Seoul (KR); Jaewan Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 248 days.

(21) Appl. No.: 18/377,447

(22) Filed: Oct. 6, 2023

(65) Prior Publication Data

US 2024/0117993 A1 Apr. 11, 2024

(30) Foreign Application Priority Data

Oct. 7, 2022 (KR) ..... 10-2022-0128429

(51) Int. Cl.
*F24F 13/20* (2006.01)
*F24F 8/108* (2021.01)

(52) U.S. Cl.
CPC ..... *F24F 13/20* (2013.01); *F24F 8/108* (2021.01)

(58) Field of Classification Search
CPC ..... F24F 13/20; F24F 8/108
USPC ..... 454/230
See application file for complete search history.

(56) References Cited

U.S. PATENT DOCUMENTS 8,414,670 B2 4/2013 Lee
12,044,429 B2 * 7/2024 Lee ..... B01D 46/4254
2011/0037368 A1 2/2011 Huang
2015/0108364 A1 4/2015 Hanai et al.
2015/0231542 A1 8/2015 Wennerstrom et al.
2015/0273376 A1 10/2015 Sohn et al.
2017/0122583 A1 5/2017 Lee et al.
(Continued)

FOREIGN PATENT DOCUMENTS

CN 101808712 8/2010
CN 104329748 2/2015
(Continued)

OTHER PUBLICATIONS

European Search Report dated Feb. 13, 2024, issued in Application No. 23201527.1.

(Continued)

*Primary Examiner* — Avinash A Savani
*Assistant Examiner* — Dana K Tighe
(74) *Attorney, Agent, or Firm* — KED & ASSOCIATES, LLP

(57) ABSTRACT

An air purifier includes a first body having an inlet formed in a circumferential surface and an outlet formed above the inlet; a fan rotatably disposed between the inlet and the outlet to form an air flow from the inlet to the outlet; a filter for removing foreign substances in air flowing into the inlet; and a second body disposed above the first body and guiding air discharged from the outlet radially outward. The second body includes: a lower cover fixedly disposed at the first body and extending radially outward in an upward direction from the outlet to guide the air discharged from the outlet; and a top cover detachably disposed above the lower cover and forming a flat surface. A protrusion is formed in a bottom surface of the lower cover and protruding downward.

17 Claims, 13 Drawing Sheets

(56) References Cited

U.S. PATENT DOCUMENTS

| | | | |
|---|---|---|---|
| 2017/0248153 | A1 | 8/2017 | Park et al. |
| 2018/0001248 | A1 | 1/2018 | Jung et al. |
| 2019/0226698 | A1 | 7/2019 | Kim et al. |
| 2020/0289968 | A1 | 9/2020 | Scholten et al. |
| 2020/0298160 | A1 | 9/2020 | Jeon et al. |
| 2020/0298165 | A1 | 9/2020 | Kang et al. |
| 2021/0207847 | A1 | 7/2021 | Lee et al. |
| 2021/0387125 | A1 | 12/2021 | Scholten et al. |
| 2022/0032222 | A1 | 2/2022 | Park et al. |
| 2022/0154953 | A1 | 5/2022 | Herskovitz et al. |
| 2022/0184542 | A1 | 6/2022 | Kim et al. |
| 2022/0184543 | A1 | 6/2022 | Choi et al. |

FOREIGN PATENT DOCUMENTS

| | | |
|---|---|---|
| CN | 206944336 | 1/2018 |
| CN | 109405123 | 3/2019 |
| CN | 208886993 | 5/2019 |
| CN | 210624810 | 5/2020 |
| CN | 112013489 | 12/2020 |
| CN | 212746822 | 3/2021 |
| CN | 113623807 | 11/2021 |
| CN | 113465085 | 12/2021 |
| CN | 216281900 | 4/2022 |
| CN | 216409143 | 4/2022 |
| CN | 216409243 | 4/2022 |
| CN | 114484709 | 5/2022 |
| CN | 114521224 | 5/2022 |
| CN | 114526534 | 5/2022 |
| CN | 216744764 | 6/2022 |
| EP | 3832217 | 6/2021 |
| GB | 2286978 | 9/1995 |
| JP | 2006-320447 | 11/2006 |
| JP | 2007-127909 | 5/2007 |
| JP | 2014-202384 | 10/2014 |
| JP | 2022-025054 | 2/2022 |
| KR | 20-0178342 | 4/2000 |
| KR | 10-2016-0025975 | 3/2016 |
| KR | 10-1652363 | 9/2016 |
| KR | 10-2017-0051276 | 5/2017 |
| KR | 10-2017-0131734 | 11/2017 |
| KR | 10-2018-0065164 | 6/2018 |
| KR | 10-1867084 | 6/2018 |
| KR | 10-2019-0119564 | 10/2019 |
| KR | 10-2019-0137048 | 12/2019 |
| KR | 10-2020-0004167 | 1/2020 |
| KR | 10-2139575 | 7/2020 |
| KR | 20-2020-0002055 | 9/2020 |
| KR | 10-2020-0111895 | 10/2020 |
| KR | 10-2021-0105856 | 8/2021 |
| KR | 10-2289453 | 8/2021 |
| KR | 10-2021-0110427 | 9/2021 |
| KR | 10-2021-0137720 | 11/2021 |
| KR | 10-2021-0140930 | 11/2021 |
| KR | 10-2022-007355 | 1/2022 |
| KR | 10-2022-0007363 | 1/2022 |
| KR | 10-2022-0007993 | 1/2022 |
| KR | 10-2022-0018766 | 2/2022 |
| KR | 10-2022-0018994 | 2/2022 |
| KR | 10-2022-0022038 | 2/2022 |
| KR | 10-2022-0059885 | 5/2022 |
| KR | 10-2022-0076876 | 6/2022 |
| KR | 10-2022-0099701 | 7/2022 |
| WO | WO 2017/074128 | 5/2017 |
| WO | WO 2017/146353 | 8/2017 |
| WO | WO 2018/016883 | 1/2018 |
| WO | WO 2021/246949 | 12/2021 |
| WO | WO 2021/246950 | 12/2021 |

OTHER PUBLICATIONS

European Search Report dated Feb. 13, 2024, issued in Application No. 23202298.8.
Korean Office Action dated Apr. 21, 2024, issued in Application No. 10-2022-0128429.
Korean Office Action dated Apr. 21, 2024, issued in Application No. 10-2022-0130152.
European Search Report dated Dec. 7, 2023, issued in Application No. 23185181.7.
European Search Report dated Dec. 8, 2023, issued in Application No. 23185189.0.
European Search Report dated Dec. 7, 2023, issued in Application No. 23185186.6.
Korean Notice of Allowance dated Nov. 28, 2024 issued in Application No. 10-2022-0128429.
Korean Office Action dated Mar. 19, 2024, issued in Application No. 10-2022-0087012.
Korean Office Action dated Mar. 19, 2024, issued in Application No. 10-2022-0087014.
U.S. Non-Final Office Action dated Feb. 20, 2024 issued in U.S. Appl. No. 18/221,200.
Korean Office Action dated Mar. 22, 2024 issued in Application No. 10-2022-0087011.
Korean Office Action dated Mar. 22, 2024 issued in Application No. 10-2022-0087010.
Korean Notice of Allowance dated Nov. 1, 2024, issued in Application No. 10-2022-0087014.
Extended European Search Report dated Nov. 16, 2023 issued in Application No. 23185149.4.
U.S. Appl. No. 18/221,031, filed Jul. 12, 2023.
U.S. Appl. No. 18/221,067, filed Jul. 12, 2023.
U.S. Appl. No. 18/221,110, filed Jul. 12, 2023.
U.S. Appl. No. 18/221,152, filed Jul. 12, 2023.
U.S. Appl. No. 18/221,200, filed Jul. 12, 2023.
U.S. Appl. No. 18/221,540, filed Jul. 13, 2023.
U.S. Appl. No. 18/221,556, filed Jul. 13, 2023.
U.S. Appl. No. 18/221,576, filed Jul. 13, 2023.
U.S. Appl. No. 18/221,589, filed Jul. 13, 2023.
U.S. Appl. No. 18/378,256, filed Oct. 10, 2023.
European Search Report dated Nov. 28, 2023, issued in Application No. 23185161.9.
European Search Report dated Dec. 1, 2023, issued in Application No. 23185203.9.
European Search Report dated Dec. 4, 2023, issued in Application No. 23185183.3.
Extended European Search Report dated Dec. 13, 2023, issued in Application No. 23185155.1.
Korean Office Action dated Apr. 16, 2024 issued in Application No. 10-2022-0087019.
Korean Office Action dated Apr. 16, 2024 issued in Application No. 10-2022-0087018.
Korean Office Action dated Apr. 16, 2024 issued in Application No. 10-2022-0087017.
Korean Office Action dated Apr. 16, 2024 issued in Application No. 10-2022-0087016.
Korean Office Action dated Apr. 16, 2024 issued in Application No. 10-2022-0087015.
Chinese Office Action dated Jul. 8, 2026 issued in Application No. 202311269929.X.

* cited by examiner

AIR PURIFIER

CROSS-REFERENCE TO RELATED APPLICATION(S)

This application claims priority under 35 U.S.C. § 119 to Korean Application No. 10-2022-0128429 filed in Korea on Oct. 7, 2022, whose entire disclosure(s) is/are hereby incorporated by reference.

BACKGROUND

1. Field

An air purifier, and more particularly, to an air purifier for enabling the use of a space above the air purifier is disclosed herein.

2. Background

An air purifier is a device that may enhance the cleanliness of the air present in a certain space by forming an air flow and filtering the air flow. In one example, the air purifier may be configured to have an intake port formed on one side, an exhaust port formed on another side, and a filter may be disposed inside the air purifier between the intake port and the exhaust port to filter air passing therebetween.

In one example, the air purifier may discharge filtered air upward in one or more directions so as to increase the cleanliness of air in the indoor space. To rapidly increase the cleanliness of air of indoor space, the air purifier may also position an exhaust port on the upper side of the air filter and may circulate the filtered air in multiple directions. In addition, when the exhaust port is formed on the upper side of the air filter, a fan for adjusting the air flow direction from the exhaust port may direct the filtered air to a distant location.

Korean Patent Application Publication No. 10-2021-0137720 discloses an air purifier with a fan that changes a direction of airflow and is disposed on the upper side of the air purifier to form a rising flow path. Since the fan to change a direction of airflow is disposed on the upper side of the upward opening exhaust port, it may be difficult to utilize an upper space of the air purifier above the fan. Furthermore, this and other conventional air purifiers are not designed to handle potential issues related to liquids spilling onto the air purifier and seeping into the interior of the air purifier when the upper space of the air purifier is used as a table to receive the liquids.

BRIEF DESCRIPTION OF THE DRAWINGS

The embodiments will be described in detail with reference to the following drawings in which like reference numerals refer to like elements wherein.

DETAILED DESCRIPTION

Figure 1:
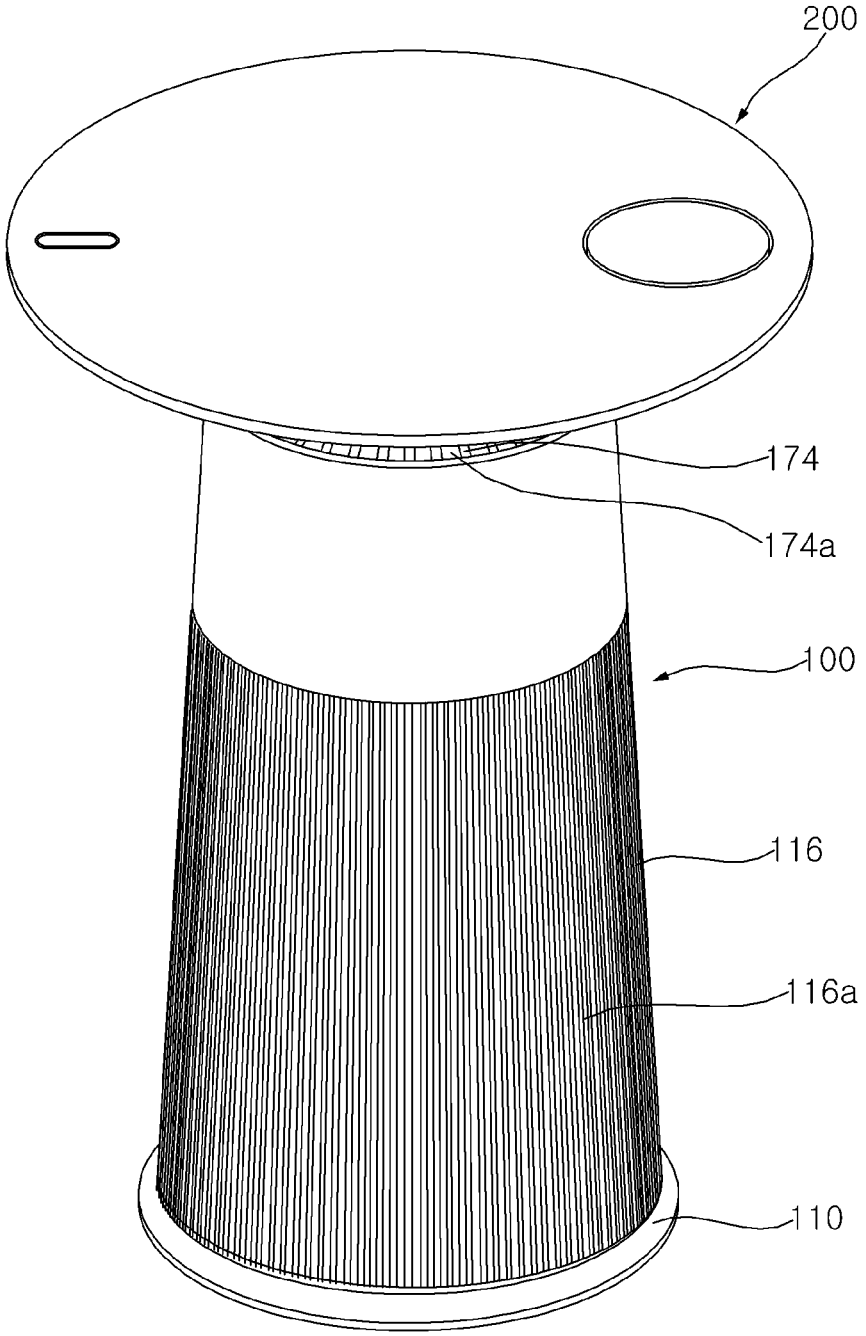
FIG. 1 is a perspective view of an air purifier according to an embodiment of the present disclosure.

Hereinafter, embodiments of the present disclosure are described in detail with reference to the accompanying drawings. However, the present disclosure is not limited to the embodiments disclosed below and may be realized in various other forms. The present embodiments make the disclosure complete and are provided to completely inform one of ordinary skill in the art to which the present disclosure pertains of the scope of the disclosure. The present disclosure is defined only by the scope of the claims. Like reference numerals refer to like elements throughout the specification.

Figure 2:
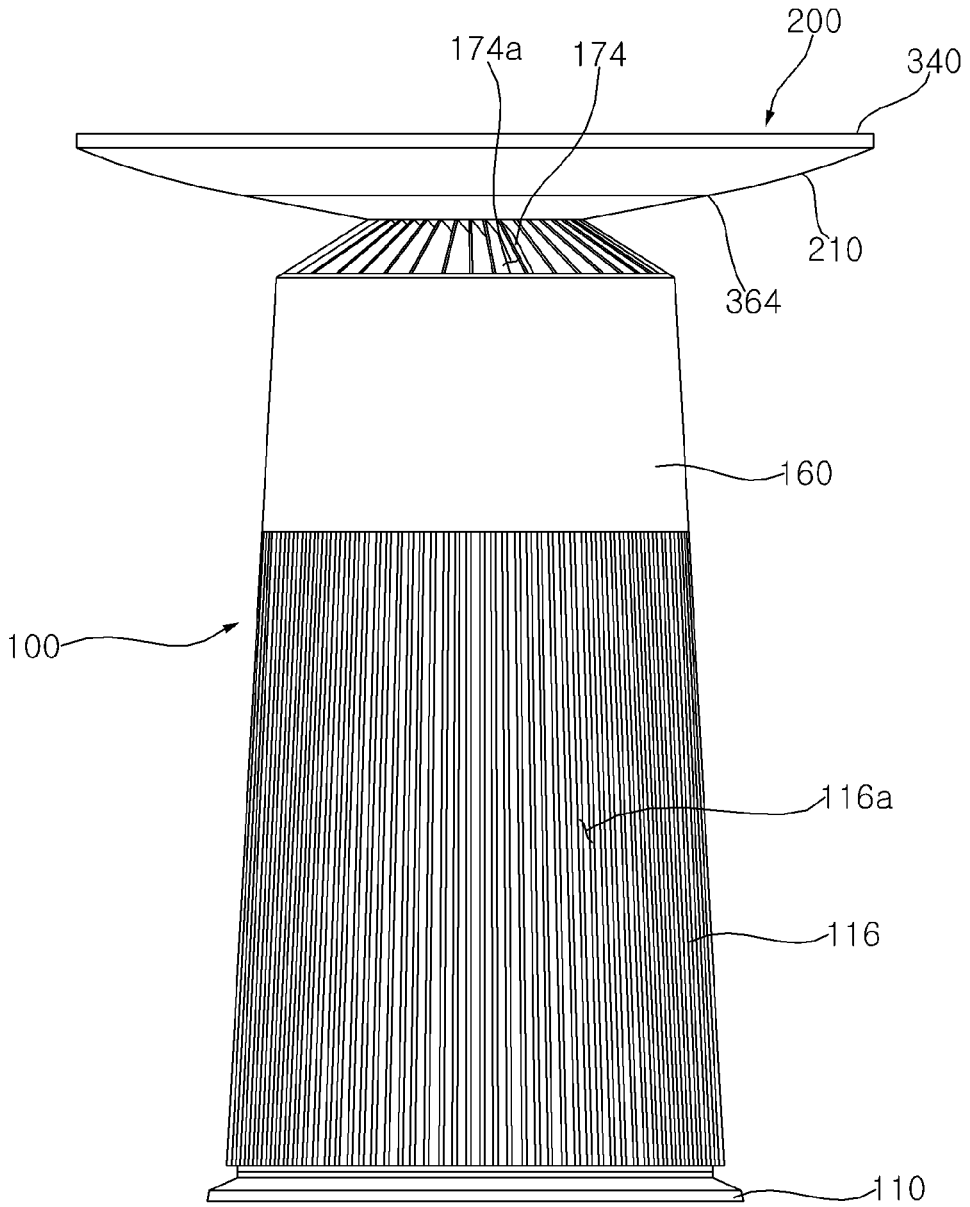
FIG. 2 is a side view of FIG. 1.
Figure 3:
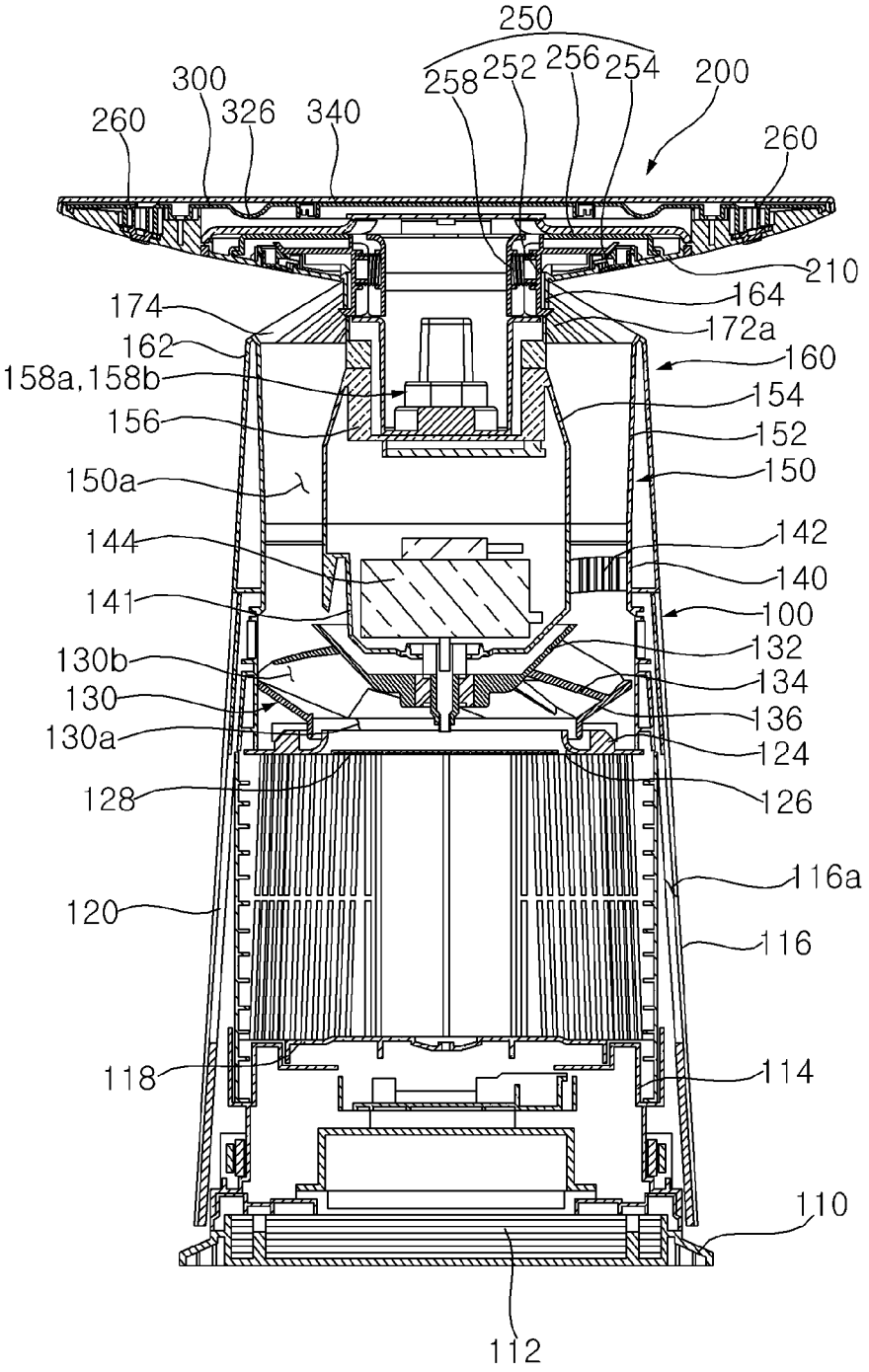
FIG. 3 is a cross-sectional view of an air purifier according to an embodiment of the present disclosure.

Hereinafter, an air purifier according to embodiments of the present disclosure will be described with reference to the drawings. Referring to FIGS. 1 to 3, an air purifier may include a first body 100 having an inlet 116*a* formed in a circumferential surface and an outlet 174*a* formed in a top surface. The air purifier may include a second body 200 disposed above the first body 100 to guide air, discharged through the outlet 174*a*, radially outward from the outlet 174*a*.

Referring to FIG. 3, the air purifier may include a base 110 disposed below the first body 100 and disposed near to or to contact the ground. In the base 110, a load portion 112 for increasing a stability of the air purifier may be disposed below the first body 100 to prevent the air purifier from overturning. The load portion 112 may include one or more plates, and these plates may be disposed to vertically overlap each other.

The first body 100 may include a lower housing 114 disposed above the base 110 and forming a space in which components such as a printed circuit board for controlling electronic operation of the air purifier are disposed. The lower housing 114 may be disposed above the base 110. A space in which the printed circuit board or the like is disposed may be formed between the lower housing 114 and the base 110.

A filter mounting plate 118 may be disposed on a top surface of the lower housing 114. The filter mounting plate 118 may be disposed close to a horizontal center of the lower housing 114. The filter mounting plate 118 may be disposed on the lower housing 114 to be movable in a vertical direction. An elastic member such as a spring may be disposed between the filter mounting plate 118 and the lower housing 114 to provide a force to move the filter mounting plate 118 away from the lower housing 114, such as to maintain a position of a filter received on the filter mounting plate 118. Thus, when a filter is not disposed on the filter mounting plate 118, the filter mounting plate 118 may be moved upward and away from the lower housing 114 by the elastic member.

The filter mounting plate 118 may be moved downward when the filter is disposed thereon. A position of the filter mounting plate 118 may be detected to determine an attachment status of the filter based on a change in vertical position of the filter mounting plate 118.

The air purifier may include the filter for filtering air introduced into the inlet 116*a*. The filter may have a cylindrical shape and may be disposed inside an inlet grille 116. For example, as previously described, filter may be provided on the filter mounting plate 118. Accordingly, the filter may filter air flowing inward and upward through the inlet 116*a*.

The first body 100 may include an inner suction panel 124 spaced apart from an upper side of the filter mounting plate 118 or the lower housing 114 and forming an orifice 126, and a supporter 120 connecting the lower housing 114 and the inner suction panel 124. A plurality of the supporters 120 may be spaced apart each other in a circumferential direction. The filter may be received in a space formed between the plurality of supporters 120.

The inner suction panel 124 may be spaced apart from the upper side of the filter mounting plate 118 or the lower housing 114 to form a space where a filter is disposed therebetween. The filter may be disposed between the inner suction panel 124 and the lower housing 114. The filter may have a cylindrical structure and may filter foreign substances in air passing through a circumferential surface of the filter. At least a portion of the filter may be disposed between the inner suction panel 124 and the lower housing 114.

When the filter is disposed between the inner suction panel 124 and the lower housing 114, the movable filter mounting plate 118 may be pressed downward by the filter. When the filter is disposed between the inner suction panel 124 and the lower housing 114, the filter may be biased upwards by the filter mounting plate 118, which may be pressed upward by the elastic member, so that the position of the filter may be fixed.

The orifice 126 through which air flows toward a fan 130, to be described below, may be formed at a horizontal center of the inner suction panel 124. The orifice 126 may guide air flowing through the filter in a direction in which the fan 130 is disposed. A steel net 128 may be disposed in the orifice 126. The steel net 128 may prevent a user's body part from entering a space where the fan 130 is disposed.

The inlet grille 116 is disposed at an outer circumference of the filter. A plurality of inlets 116*a* may be formed in the inlet grille 116. The inlet grille 116 may be disposed to cover, for example, an outer circumference surface of the filter and an outer circumference of the lower housing 114. The inlet grille 116 may be disposed to also cover an outer circumference of a fan housing 140, which will be described below. The inlet 116*a* formed in the inlet grille 116 may be formed in a circumferential surface of an area where the filter is disposed.

The air purifier may include the fan 130 that is rotatably disposed inside the first body 100, and a fan motor 144 for rotating the fan 130. For example, the first body 100 may include the fan housing 140 forming a space in which the fan 130 is disposed above the filter.

In the first body 100, the fan 130 may be disposed above the inner suction panel 124 and air, introduced through the orifice 126, may flow upward toward the fan 130. In addition, in the first body 100, the fan motor 144 may be disposed above the fan housing 140 for operating the fan 130.

The fan 130 may have a centrifugal fan structure, including a fan suction port 130*a* that may be directed downward and a fan discharge port 130*b* that may be open, for example, in outward and upward radial directions. The fan 130 may include a hub 132 connected to the fan motor 144, a shroud 136 spaced apart from the hub 132 and forming the fan suction port 130*a*, and a plurality of blades 134 connecting the hub 132 and the shroud 136 and that are spaced apart from each other in a circumferential direction. The fan discharge port 130*b* may be formed between the hub 132 and the shroud 136. The plurality of blades 134, when rotated, may form a flow of air to be discharged through the fan discharge port 130*b*.

The fan housing 140 may be disposed above the inner suction panel 124. The fan housing 140 may form a space in which at least a portion of the fan 130 is disposed. Additionally or alternatively, the fan housing 140 may form a space in which the fan motor 144 is disposed above the fan 130. Additionally or alternatively, the fan housing 140 may form at least a portion of a flow path for guiding upward the air flowing from the fan 130.

The fan housing 140 may have a cylindrical shape that is open both at the top and bottom. A motor cover 141 in which the fan motor 144 may be disposed may be disposed approximately at the center of the fan housing 140. The motor cover 141 may have, for example, a bowl shape recessed downward to accommodate the fan motor 144.

The fan housing 140 may include a guide vane 142 disposed above the space where the fan 130 is disposed, which may guide air flowing from fan 130, such as to reduce rotational components of air flowing from the fan 130. The guide vane 142 may be disposed, for example, to connect an inner circumferential surface of the fan housing 140 and an outer peripheral surface of the motor cover 141. A plurality of guide vanes 142 may be spaced apart in a circumferential direction.

The first body 100 may include a discharge guider (or guide) 150 for directing an upward flow of air flowing upward through the fan housing 140. The discharge guider 150 may be disposed above the fan housing 140 and may form an annular flow path 140*a* therein.

The discharge guider 150 may include an outer guider 152 having, for example, a cylindrical shape and extending upward, and an inner guider 154 may be disposed radially inward from the outer guider 152 and may extend upward. In the space between the outer guider 152 and the inner guider 154, an annular rising flow path 150*a* may be formed. The outer guider 152 may extend from the outer circumferential surface of the fan housing 140. The inner guider 154 may have a structure extending upward from the motor cover 141.

At an upper portion of the inner guider 154, there may be a coupling cover 156 into which an insertion post 212 of the second body 200 (which will be described later) is inserted. The coupling cover 156 may form a space recessed downward for the insertion post 212 to be inserted thereinto. At a bottom surface of the coupling cover 156, there may be connection terminals 158*a* and 158*b* to which corresponding terminals 214*a* and 214*b* of the insertion post 212 may be coupled.

The connection terminals 158*a* and 158*b* may include, for example, a power terminal for supplying power and a signal terminal for transmitting signals. The connection terminal may include, for example, at least first connection terminal 158*a* for transmitting power and at least one second connection terminal 158*b* for transmitting signals. It should be appreciated that the connection terminal may include additional or different terminals.

The first body 100 may include an upper housing 160 forming the outlet 174*a* through which air flowing upward of the discharge guider 150 is discharged. The upper housing 160 may be disposed to cover a circumference of the discharge guider 150. The upper housing 160 may have a structure extending upward from the inlet grille 116.

The upper housing 160 may include, for example, an outer cover 162 extending to the upper side of the inlet grille 116, an inner cover 164 disposed radially inward from the outer cover 162 and extending to the upper side of the coupling cover 156, and an outlet grille 174 connecting a top of the inner cover 164 and the outer cover 162. The outer cover 162 is disposed to cover the circumference of the discharge guider 150. The outer cover 162 is disposed to extend to the upper side of the inlet grille 116.

The inner cover 164 may guide the insertion post 212 to be inserted into the coupling cover 156. The inner cover 164 may have a structure extending upward from the coupling cover 156. The inner cover 164 may be formed approximately in a cylindrical shape, allowing the insertion post 212 to be disposed therein.

Figure 4:
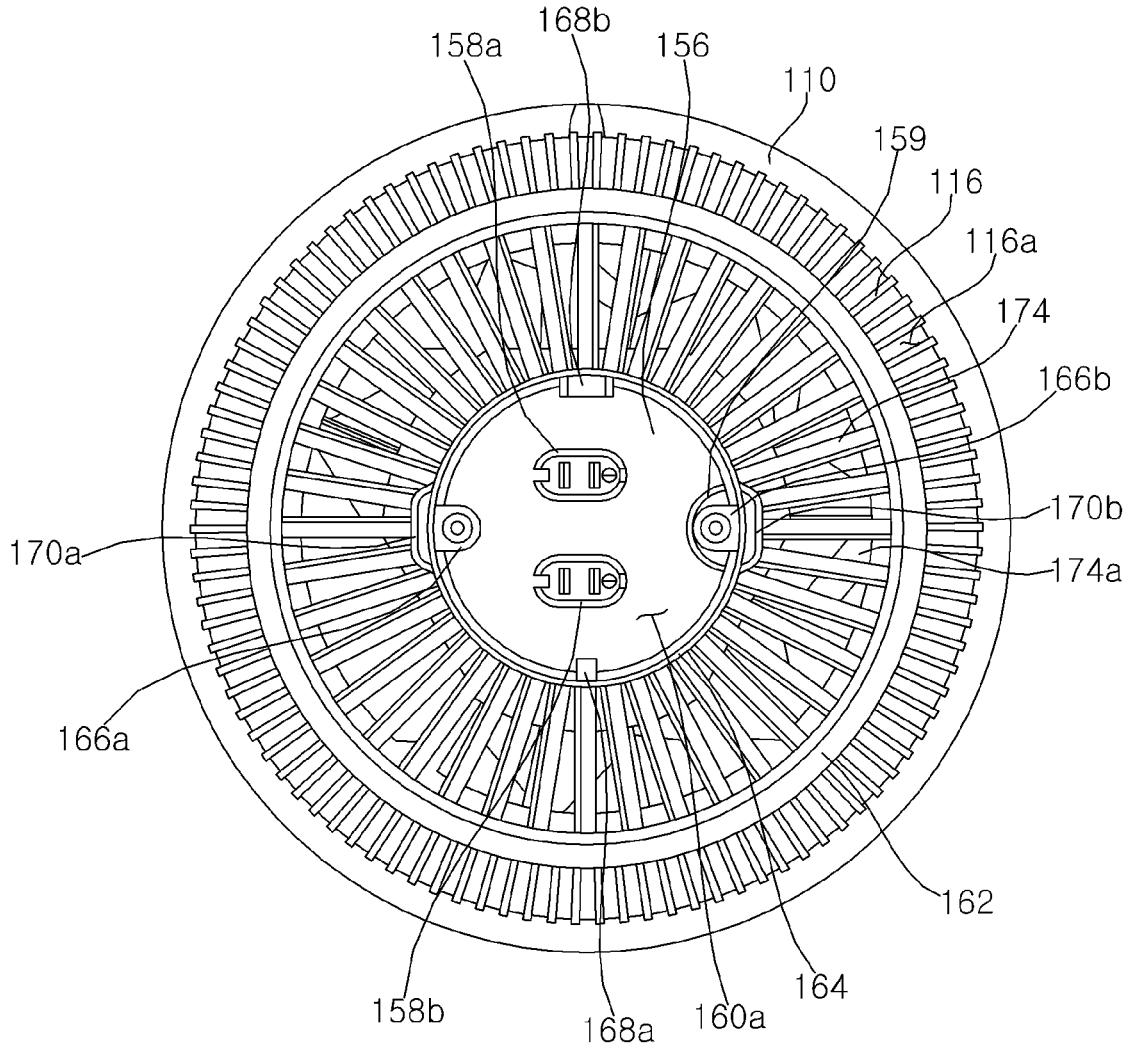
FIG. 4 is a plan view of a first body of an air purifier according to an embodiment of the present disclosure.
Figure 5:
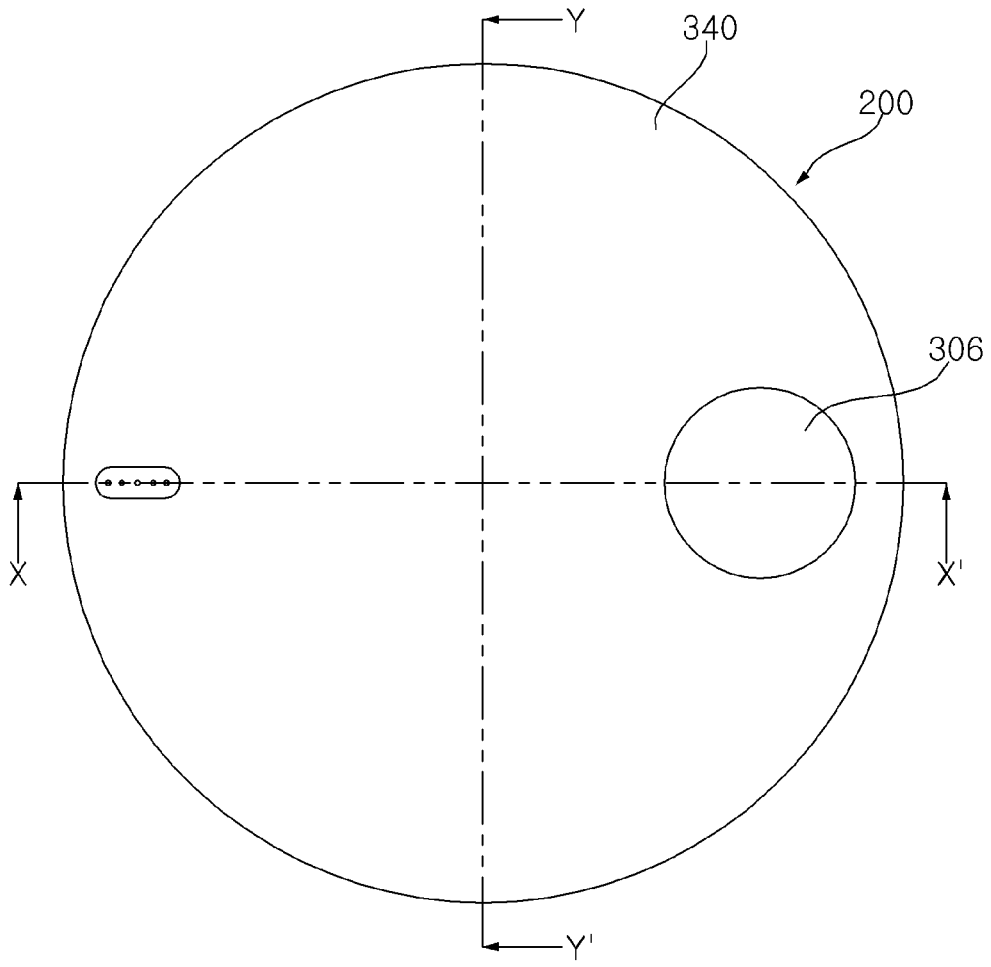
FIG. 5 is a plan view of a second body of an air purifier according to an embodiment of the present disclosure.
Figure 6:
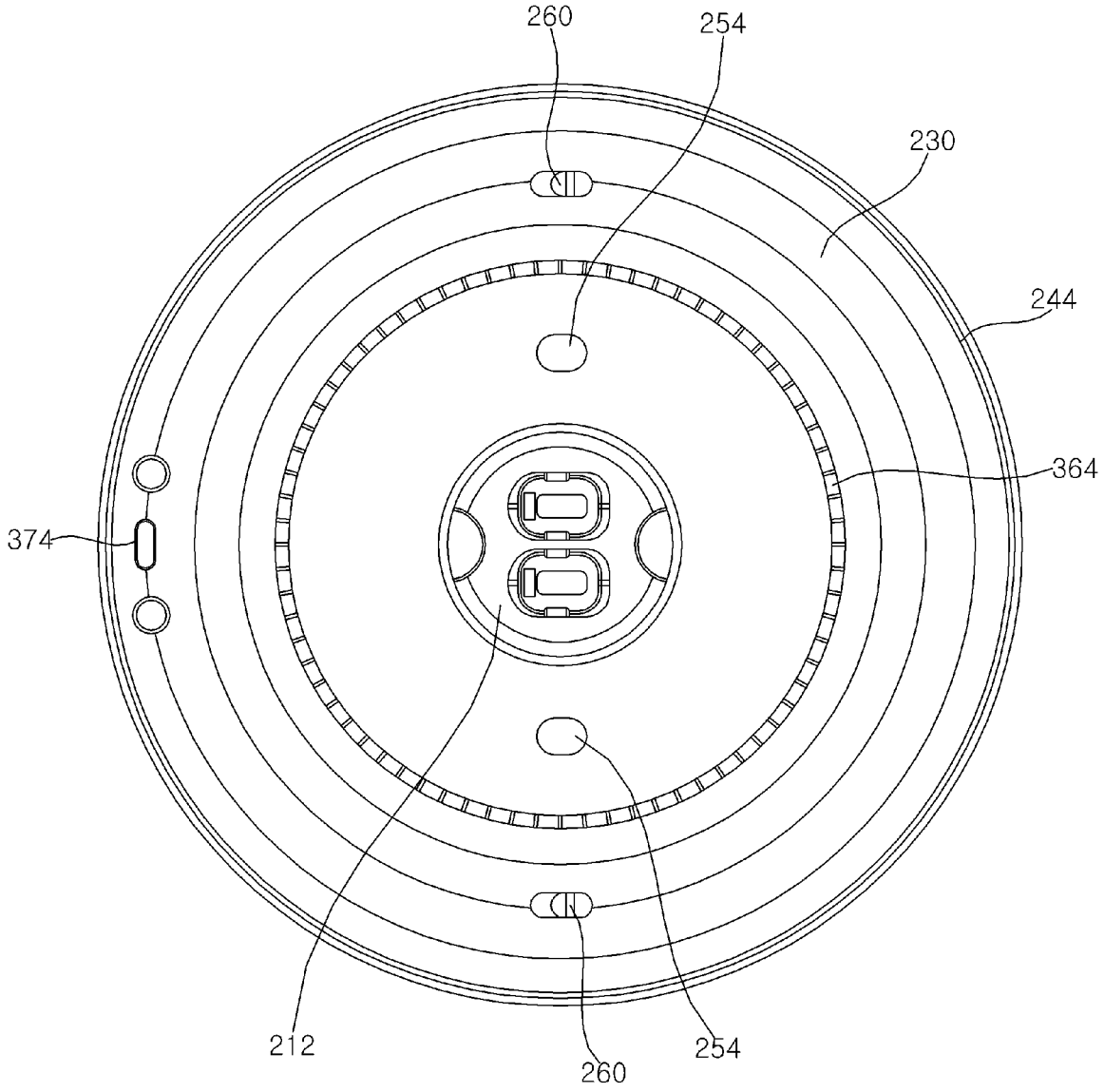
FIG. 6 is a bottom view of a second body of an air purifier according to an embodiment of the present disclosure.

A fastening rib 166*a* or 166*b* coupled to the coupling cover 156 may be disposed at an inner circumferential surface of the inner cover 164. Referring to FIG. 4, two fastening ribs 166*a* and 166*b* disposed opposite to each other are disposed at the inner circumferential surface of the inner cover 164. For example, the two fastening ribs 166*a* and 166*b* may be disposed in mutually-facing directions and may have a substantially same size.

A fastening hole 172*a* or 172*b* may be formed in the inner circumferential surface of the inner cover 164, and the fastening hole 172*a*, 172*b* may be configured to receive a hook 252 disposed on the second body 200. A pair of fastening holes 172*a* and 172*b* may be provided in opposite directions. The fastening holes 172*a* and 172*b* may be disposed above the two fastening ribs 166*a* and 166*b*, respectively.

An upper groove 170*a* and 170*b* is formed in the inner circumferential surface of the inner cover 164 to guide the hook 252 to the fastening hole 172*a* and 172*b*. The upper groove 170*a* or 170*b* may be formed above the fastening hole 172*a* or 172*b*. The fastening hole 172*a* or 172*b* may be spaced downward from the top of the inner cover 164.

At least two guide ribs 168*a* and 168*b* may be disposed at the inner circumferential surface of the inner cover 164 so that the second body 200 may be mounted at the same position. The two guide ribs 168*a* and 168*b* may be disposed opposite to each other. The two guide ribs 168*a* and 168*b* may be formed with different sizes.

The outlet grille 174 may have a structure extending from the top of the inner cover 164 to the outer cover 162. Referring to FIG. 3, the top of the inner cover 164 may be formed higher than a top of the outer cover 162. The upper housing 160 may include a plurality of outlet grilles 174 spaced apart from the top of the inner cover 164 in a circumferential direction.

Each of the plurality of outlet grilles 174 may have a shape in which an inclination angle (or pitch) at an inner end is different from an inclination angle at an outer end, such as to guide air flow in a different directions, respectively, at the inner and outer ends. Here, the inner end of the outlet grille 174 may be a portion where the outlet grille 174 comes into contact with the inner cover 164. The outer end of the outlet grille 174 may be a portion where the outlet grille 174 comes into contact with the outer cover 162. Here, an inclination angle may refer to an angle formed between a line or plane parallel to the ground and a plane formed by the outlet grille 174. The outlet grille 174 may guide an outputted air flow, such as to remove rotational components of discharged air generated by the fan 130.

Referring to FIG. 4, in the first body 100, a coupling recess 160*a* recessed downward may be formed inside the circular-shaped outlet 174*a*. The coupling recess 160*a* may be formed on an inner side of the inner cover 164 formed in the upper housing 160. The coupling recess 160*a* may be formed on an inner side the inner guider 154 of the discharge guider 150. In the coupling recess 160*a*, the connection terminals 158*a* and 158*b* may be disposed at the coupling cover 156.

The coupling recess 160*a* is an area where the insertion post 212 of the second body 200 may be inserted, and may be formed across the discharge guider 150 and the upper housing 160. Therefore, the coupling recess 160*a* may include, for example, a structure formed on the inner side of the inner cover 164, a structure formed on an inner circumferential surface of the inner guider 154, and a structure formed on the coupling cover 156.

Hereinafter, the second body 200 of the air purifier according to an embodiment of the present disclosure will be described with reference to FIGS. 3 and 5 to 12. Referring to FIG. 3, a bottom surface of the second body 200 may guide the air flow, flowing upward through the outlet 174, to flow radially outward. At least a part of a top surface of the second body 200 may be flat so as to provide a storage surface to be used as a top of a table. An area formed by the top surface of the second body 200 may be larger than an area formed by the outlet 174*a*. When viewed from above, the outlet 174*a* formed in the first body 100 may have a structure covered by the top surface of the second body 200. Thus, it may be possible to prevent liquid or objects flowing from the top surface of the second body 200 from reaching the outlet 174*a* since the second body would guide such a liquid or objects radially outward and away from the outlet 174*a*.

Figure 7:
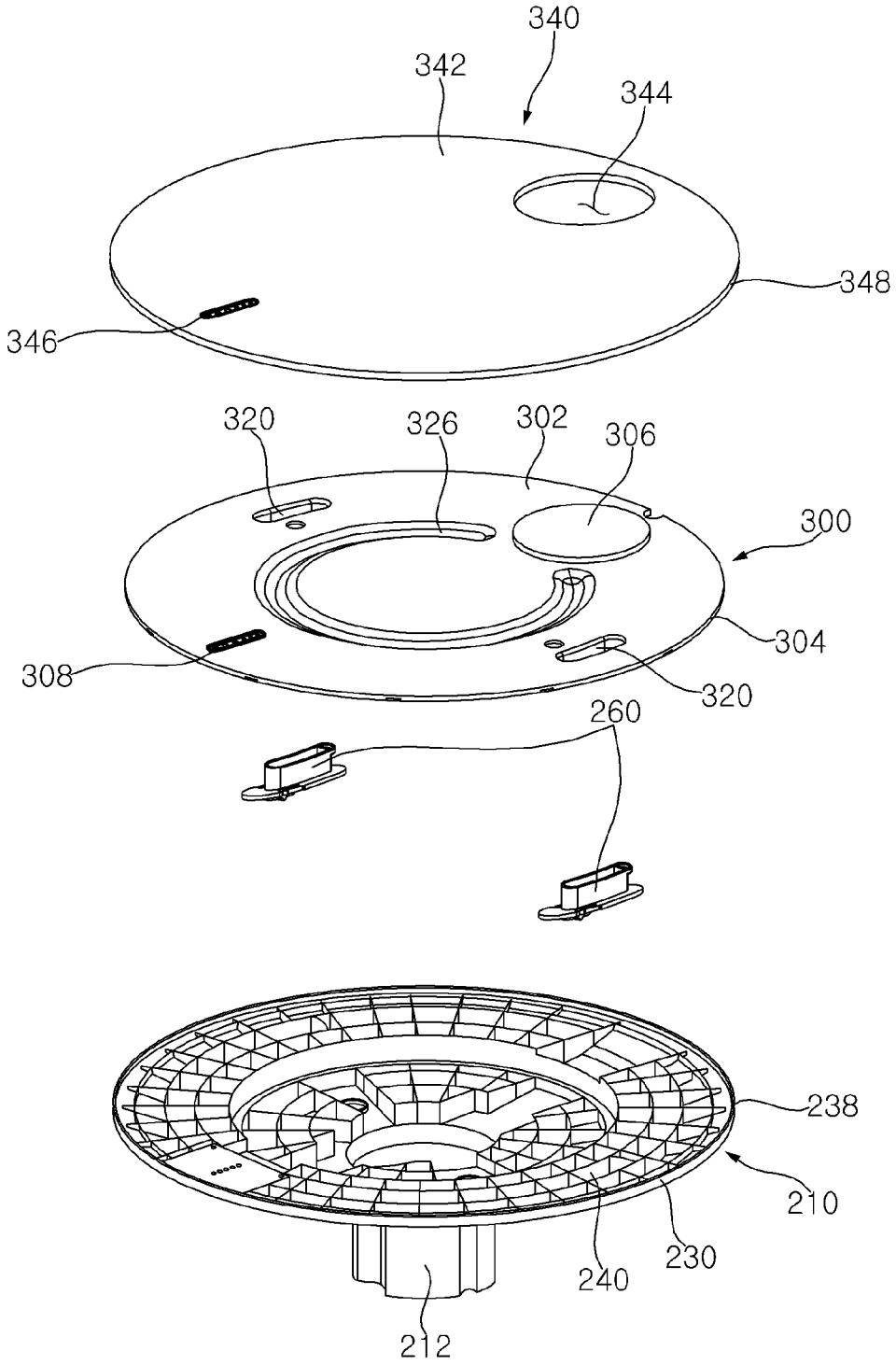
FIG. 7 is an exploded perspective view of a second body of an air purifier according to an embodiment of the present disclosure.
Figure 8:
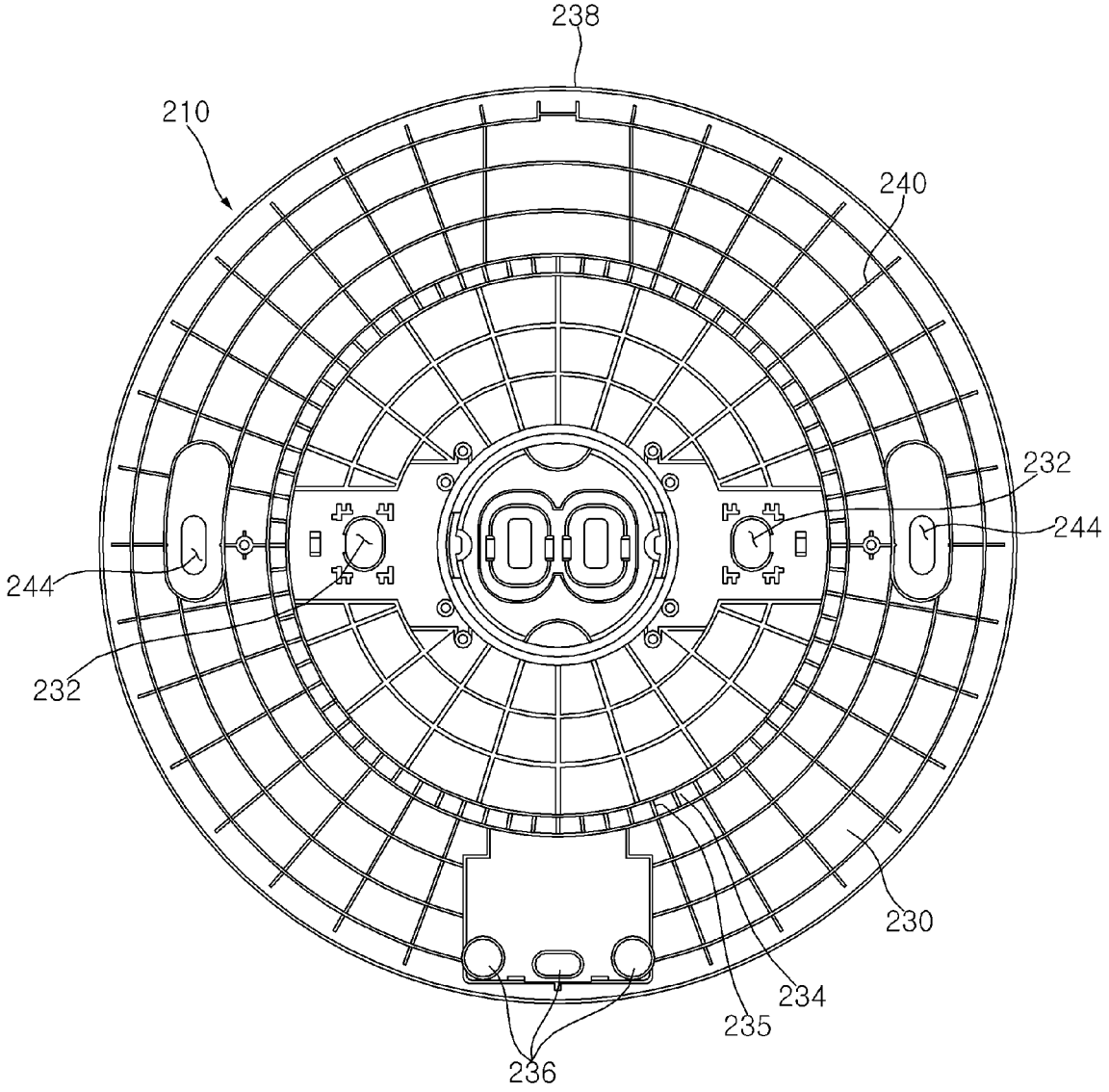
FIG. 8 is a plan view of a lower cover of an air purifier according to an embodiment of the present disclosure.

Referring to FIG. 7, the second body 200 may include a lower cover (or first cover) 210 that directs the air discharged through the outlet 174*a* of the first body 100 radially outward, an upper cover (also referred to as a third cover or an intermediate cover) 300 disposed on top of the lower cover 210, and a top cover (or second cover) 340 disposed on top of the upper cover 300.

The second body 200 may further include a coupling portion (or coupling protrusion) 250 for fixing the second body 200 to the top of the first body 100. The coupling portion 250 may have a structure protruding outward from the circumferential surface of the insertion post 212 of the second body 200 so as to fix the position of the second body 200 when the insertion post 212 is placed in the coupling recess 160*a* of the first body 100.

The top surface of the second body 200 (e.g., an upper surface of top cover 340) may be formed of a wear-resistant material, such as polycarbonate (PC). Therefore, the top surface of the second body 200 may be formed of a material that is not abraded even when hit by an object mounted thereon. The top surface of the second body 200 may be formed of a heat-resistant material, such as a heat resistant PC material. Even if a hot object, such as a cup holding a hot liquid, is placed on the top surface of the second body 200, it is possible to minimize shape deformation hue to heat from the hot object.

The lower cover 210 may be fixedly disposed on one side of the first body 100 and may guide air discharged from the outlet 174*a* of the first body 100 to spread radially outward. The lower cover 210 may have a bowl shape forming a space in which electrical components or other items may be disposed. The electrical components may refer to devices that can operate electrically. In the embodiment, the electrical components may include, for example, a charger 380, a first lamp 362, and a second lamp 372.

The lower cover 210 may include the insertion post 212 inserted into the coupling cover 156 of the first body 100, and a guide wall 230 disposed above the outlet grille 174 of the first body 100 and expanding in diameter in an upward direction. The insertion post 212 may include a circumferential wall 216 inserted into the coupling cover 156, and a lower wall 214 may be disposed at a lower end of the circumferential wall 216.

A corresponding terminal 214*a* or 214*b* corresponding to the connection terminal 158*a* or 158*b* of the coupling cover 156 may be disposed at the lower wall 214. The corresponding terminal 214*a* or 214*b* may include, for example, a terminal for receiving power from the connection terminal 158*a* or 158*b* and a terminal for receiving signals.

For example, terminals 214*a* and 214*b* may be connected to connection terminals 158*a* and 158*b*, respectively. The two corresponding terminals may include a first corresponding terminal 214*a* connected to the first connection terminal 158*a*, and a second corresponding terminal 214*b* connected to the second connection terminal 158*b*. The first connection terminal 158*a* may be connected to the first corresponding terminal 214*a* to receive power, and the second connection terminal 158*b* may be connected to the second corresponding terminal 214*b* to receive control or sensor signals. For example, when the second body 200 is mounted on the first body 100, the corresponding terminals 214*a* and 214*b* may be positioned adjacent to and connected to the connection terminals 158*a* and 158*b*.

In the circumferential surface, fastening rib grooves 218*a* and 218*b* may be formed to allow the fastening ribs 166*a* and 166*b* to be inserted when the second body 200 is mounted on the first body 100. Two fastening rib grooves 218*a* and 218*b* may be formed in the circumferential wall 216. The two fastening rib grooves 218*a* and 218*b* may be disposed substantially opposite to each other on the circumferential wall 216.

In the circumferential wall 216, a guide groove 220*a* or 220*b* may be formed to allow the guide rib 168*a* or 168*b* to be inserted when the second body 200 is mounted on the first body 100. Two guide grooves 220*a* and 220*b* of different sizes may be formed in the circumferential wall 216. The two guide grooves 220*a* and 220*b* may be disposed to have sizes and positions corresponding to those of the two guide ribs 168*a* and 168*b* such that the guide grooves 220*a* and 220*b* may receive guide ribs 168*a* and 168*b*.

Since each of the two guide ribs 168*a* and 168*b* of different sizes may be inserted into a corresponding one of the two guide grooves 220*a* and 220*b*, the position where the second body 200 is coupled to the top of the first body 100 may be maintained. Therefore, the first connection terminal 158*a* and the second connection terminal 158*b* may be connected to the first corresponding terminal 214*a* and the second corresponding terminal 214*b*, respectively, when the second body 200 is coupled to the first body 100.

In the circumferential wall 216, a hook hole 222 for the hook 252 of the coupling portion 250 to pass therethrough may be formed. The hook hole 222 may be disposed, for example, above each of the fastening rib grooves 218*a* and 218*b*.

An edge groove 224 into which a top of the inner cover 164 of the upper housing 160 is inserted may be formed at a top of the insertion post 212. At the top of the insertion post 212, the edge groove 224 may form a groove in an upward direction where a portion of the guide wall 230 may be disposed.

The guide wall 230 may be disposed above the outlet 174*a* and may have a shape extending upward from the outlet 174*a*. The guide wall 230 may have a shape in which a diameter from a center vertical axis of the lower body 230 increases in an upward direction. For example, referring to FIG. 2, the guide wall 230 may have a shape in which an inclination angle increases upward from a lower end. Here, the inclination angle may refer to an angle formed between a plane parallel to the ground and an outer surface of the guide wall 230.

The lower end of the guide wall 230 may start from the top of the inner cover 164. The top of the guide wall 230 may be larger than the diameter of the circumferential surface formed by the outer cover 162. In the guide wall 230, there may be a hook button hole 232 in which a hook button 254 of the coupling portion 250 may be disposed (see FIG. 3).

In the guide wall 230, there may be a lighting hole 234 through which a part of a light source guide 364 may be exposed. The lighting hole 234 may be formed in a ring shape. The lighting hole 234 may be divided into a plurality of regions by a support rib 235 supporting a bottom of the light source guide 364.

In the guide wall 230, there may be a holder hole 244 into which a fixing holder (or latch) 260 may be mounted. The fixing holder 260 may be mounted in the holder hole 244 to be reciprocally movable.

In the guide wall 230, there may be at least one main button hole 236 in which at least one button 374 is disposed. In one example, the main button hole 236 may be formed in a quantity corresponding to the number of buttons 374 disposed thereon, such that a separate main button hole is provided for the button 374, or multiple buttons 374 may be positioned in a single button hole 236. The main button hole 236 may be formed in a shape corresponding to the shape of the button 374 to be disposed.

The fixing holder 260 may be movably mounted in the holder hole 244. A part of the fixing holder 260 may be exposed through the lower side of the guide wall 230. Therefore, a user may be able to move the fixing holder 260 by contacting a bottom surface of the fixing holder 260.

The fixing holder 260 may be formed such that an upper portion thereof protrudes along a moving direction of the fixing holder 260. Accordingly, depending on the placement, the fixing holder 260 may be inserted into a holder cap 354 formed in the top cover 340 or may be spaced apart from the holder cap 354. When one side of the fixing holder 260 is inserted into the holder cap 354, the top cover 340 may be fixed to the lower cover 210.

The lower cover 210 may include a protrusion 237 protruding downward from a bottom surface of the guide wall 230. The protruding portion 237 may be disposed to protrude downward from a bottom surface of the lower cover 210. The protruding portion 237 may be disposed to protrude downward and radially outward from the bottom surface of the lower cover 210.

The protrusion 237 may be disposed to extend in a circumferential direction from the bottom surface of the lower cover 210. The protrusion 237 may be spaced apart radially inward from a peripheral wall 348 of the top cover 340.

The protrusion 237 may be spaced apart radially outward from the outlet 174*a* formed in the first body 100. The protrusion 237 may be disposed radially outward from a bottom of the light source guide 364. The protrusion 237 may be disposed at an outer peripheral end of the guide wall 230.

Figure 13:
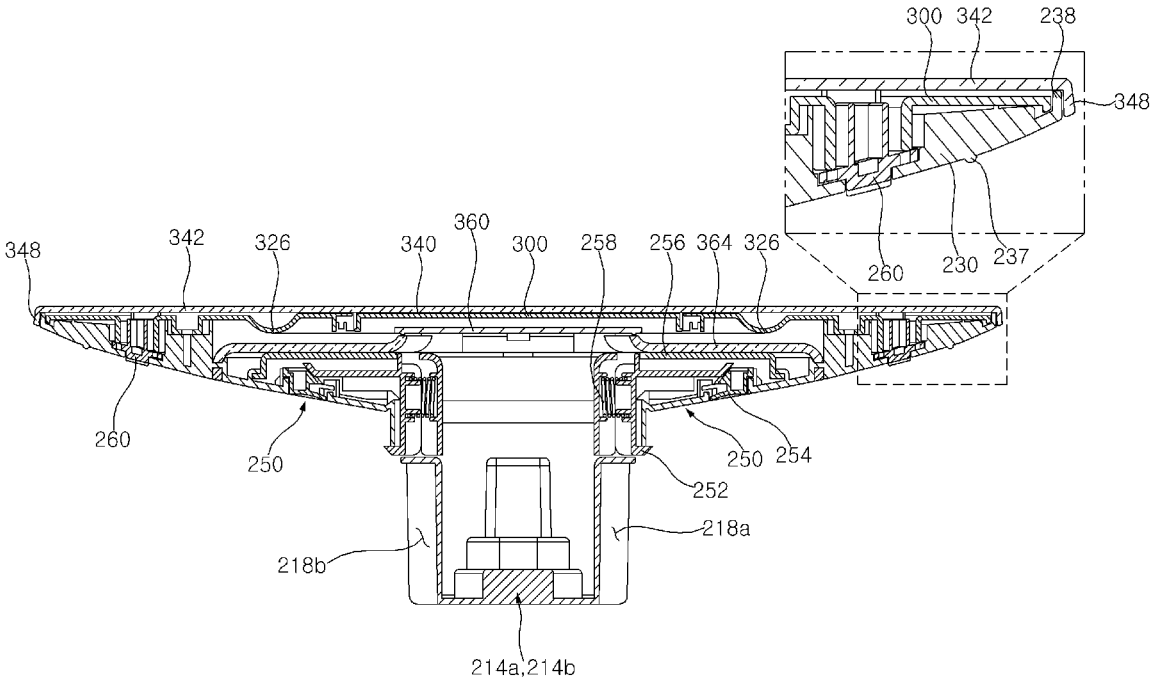
FIG. 13 is a cross-sectional view of a second body of an air purifier according to an embodiment.
Figure 14:
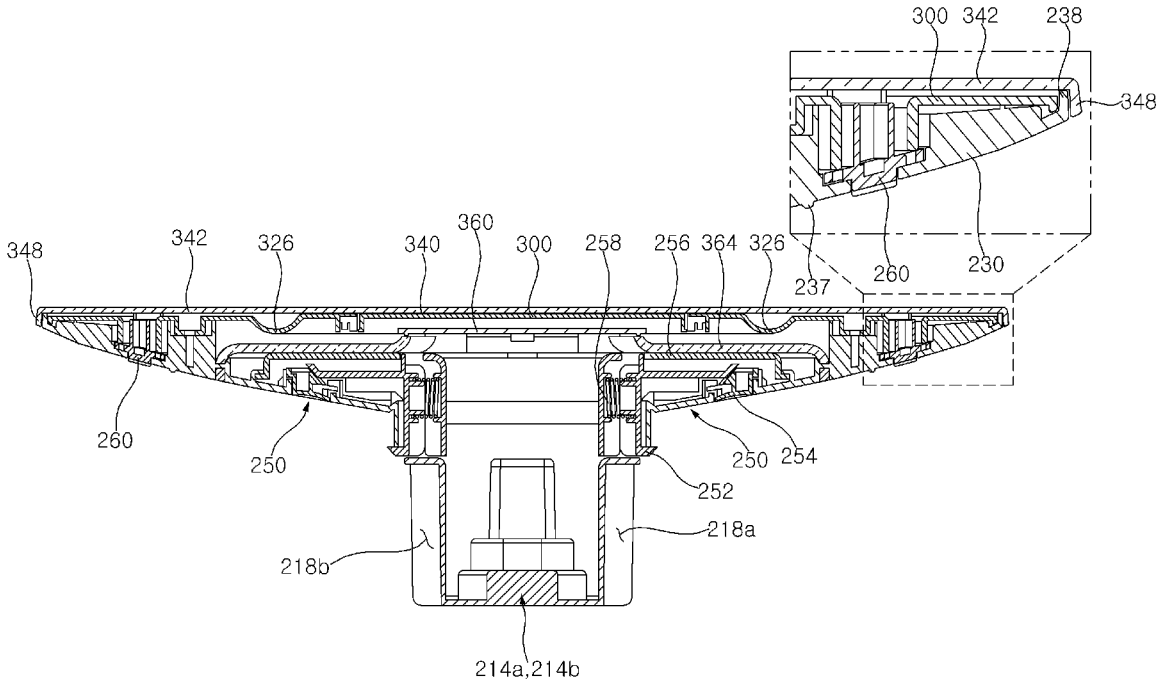
FIG. 14 is a cross-sectional view of a second body of an air purifier according to an embodiment.

The protrusion 237 may be disposed at the lower cover 210 radially outward compared to a position where the outlet 174*a* is formed. Accordingly, the protrusion 237 may be disposed at the lower cover 210 between an edge rib 238 and the fixing holder 260, as shown in FIG. 13. In another example, the protrusion 237 may be disposed at the lower cover 210 between the fixing holder 260 and the bottom of the light source guide 364, as shown in FIG. 14.

The lower cover 210 may include a plurality of ribs protruding upward from the upper side of the guide wall 230. For example, the lower cover 210 may include the edge rib 238 protruding upward from a top of the guide wall 230. Referring to FIG. 7, the edge rib 238 may be disposed inside the peripheral wall 348 of the top cover 340. The edge rib 238 may be disposed, foe example, at outer circumference of a plate edge 304 of the upper cover 300.

A step may be formed in the edge rib 238 to fix the position of the inner protrusion 349 of the top cover 340. On one side of the edge rib 238, there may be a fixing groove 238*a* recessed inward to accommodate the inner protrusion 349 of the top cover 340. When the inner protrusion 349 of the top cover 340 is disposed in the fixing groove 238*a* of the lower cover 210, the top cover 340 may be positioned and fixed on the upper side of the lower cover 210.

The lower cover 210 includes a plurality of partition ribs 240 and 242 extending upward from a top surface of the lower cover 210 and partitioning an upper space of the lower cover 210. The plurality of partition ribs 240 and 242 may have a concentric circular structure with different radii. The plurality of partition ribs 240 and 242 may have a radially extending structure.

The plurality of partition ribs 240 and 242 includes a first partition rib 242*a* disposed to face the edge rib 238. The plurality of partition ribs 240 and 242 includes a plurality of radial ribs 240 extending radially outward from a lower part of the upper side of the guide wall 230, and a plurality of cylindrical ribs 242 formed in a ring shape with different radii on the upper side of the guide wall 230. The plurality of cylindrical ribs 242 may have a substantially common center. For example, the plurality of cylindrical ribs 242 may have a same concentric center as the edge rib 238.

The plurality of cylindrical ribs 242 may have different radii and may protrude upward from the guide wall 230 to partition the upper space of the lower cover 210. Therefore, even if water or other liquid flows in from the upper cover 300, it may be possible to prevent water or other liquid from flowing into the inner space of the lower cover 210, such that electronic components in the lower cover 210 would not be exposed to the split water.

The plurality of cylindrical ribs 242 may include a first cylindrical rib 242*a* disposed adjacent to the edge rib 238. The first cylindrical rib 242*a* may face the edge rib 238.

The coupling portion 250 may be disposed inside the second body 200 to couple or decouple the second body 200 to or from the first body 100. Referring to FIG. 3, the coupling portion 250 includes a hook 252 movably disposed inside the lower cover 210, and a hook button 254 that changes the position of the hook 252.

The coupling portion 250 includes a hook guider 256 disposed inside the lower cover 210 to guide movement of the hook 252, and an elastic member 258 disposed between the hook guider 256 and the hook 252. When a user's force is not applied to the hook button 254, the elastic member 258 may push the hook 252 radially outward. When the user's force is not applied to the hook button 254, the hook button 254 may be exposed through the hook button hole 232 of the lower cover 210. When the user's force is not applied to the hook button 254, the insertion protrusion 266 of the hook 252 may protrude outward from the insertion post 212 through the hook hole 222 of the lower cover 210.

Above the lower cover 210, there may be a plurality of first lamps 362, a first board 360 for operating the plurality of first lamps 362, and the light source guide 364 for transmitting light emitted from the first lamps 362 to the lower side of the lower cover 210. The first board 360 may be in a disc-shaped form. A plurality of first lamps 362 may be disposed at a bottom surface of the first board 360. The plurality of first lamps 362 may be spaced apart from the bottom surface of the first board 360 in a circumferential direction.

The light source guide 364 may have one end disposed below the plurality of first lamps 362. The other end of the light source guide 364 may be disposed in the lighting hole 234 formed in the guide wall 230 of the lower cover 210.

Above the lower cover 210, there may be a plurality of second lamps 372 displaying, for example, an operating status of the air purifier or other information, and a second board 370 for operating the plurality of second lamps 372. The plurality of second lamps 372 may indicate the operating status of the air purifier to the user based on, for example, a lighting position, a color, a brightness, or a quantity of lit ones of the plurality of second lamps 372.

The second board 370 may be formed approximately in a rectangular plate shape. The plurality of second lamps 372 may be disposed at a top surface of the second board 370. The plurality of second lamps 372 may be spaced apart from the top surface of the second board 370 in a vertical direction.

Below the second board 370, there may be a button 374 for receiving a user input, such as for controlling an operation or power of the air purifier. The button 374 may be disposed in the main button hole 236 of the lower cover 210. The button 374 may include a plurality of button parts. The plurality of button parts included in the button 374 may be of different sizes or shapes. The plurality of button parts included in the button 374 may be formed to protrude from the lower cover 210 in one or more different directions.

The charger 380 may be disposed above the lower cover 210. The charger 380 may charge an electronic device disposed on the upper cover 300 or the top cover 340. For example, the charger 380 may wirelessly supply power to an electronic device placed on the upper cover 300 or top cover 340 by using magnetic induction or resonance.

The charger 380 may include a charging pad 384 for supplying power to an electronic device disposed adjacent thereto, a third board 382 for controlling the operation of the charging pad 384, and an inner plate 386 for fixing the positions of the charging pad 384 and the third board 382. The inner plate 386 may be disposed above the light source guide 364. The inner plate 386 may be fixedly disposed at the light source guide 364 or the lower cover 210.

In the inner plate 386, there may be a board fixing part 390 where the third board 382 is fixed, and a pad fixing part 392 where the charging pad 384 is fixed. The pad fixing part 392 may be formed with a groove for the charging pad 384 to be inserted thereinto.

The upper cover 300 may be disposed to cover the top of the lower cover 210. The upper cover 300 may cover electrical components disposed inside the lower cover 210. For example, the upper cover 300 may be formed approximately in a disc shape. The upper cover 300 may have a shape corresponding to the top surface of the lower cover 210.

The upper cover 300 may include a plate 302, and at least one protruding cover 306 or 308 protruding upward from the plate 302. The upper cover 300 may include a plurality of protruding covers 306 and 308 spaced apart from each other in the plate 302. For example, the upper cover 300 may include plate 302 having a disk shape, a plate edge 304 bent downward at an outer circumference of the plate 302, a first protruding cover 306 disposed upward from the plate 302 and covering a top of the charging pad 384 of the charger 380, and a second protruding cover 308 protruding upward from the plate 302 and covering a top of the second lamp 372. A groove 326 that is recessed downward may be formed in the plate 302.

The plate 302 may be formed approximately in a disk shape. The plate 302 may be disposed to cover the top of the lower cover 210. A diameter of the plate 302 may be smaller than a diameter of the top of the lower cover 210. The plate edge 304 may have a structure bent downward from the outer circumference of the plate 302. The diameter of the plate 302 may be larger than a diameter formed by the first cylindrical rib 242*a*. Thus, a fluid flowing downward along the plate 302 may flow to the outside of the first cylindrical rib 242*a*.

A groove 326 for temporarily collecting fluid flowing between the top cover 340 and the upper cover 300 through a mounting hole 344 formed in the top cover 340 may be formed in the plate 302. The groove 326 recessed downward may be formed in the plate 302.

Figure 9:
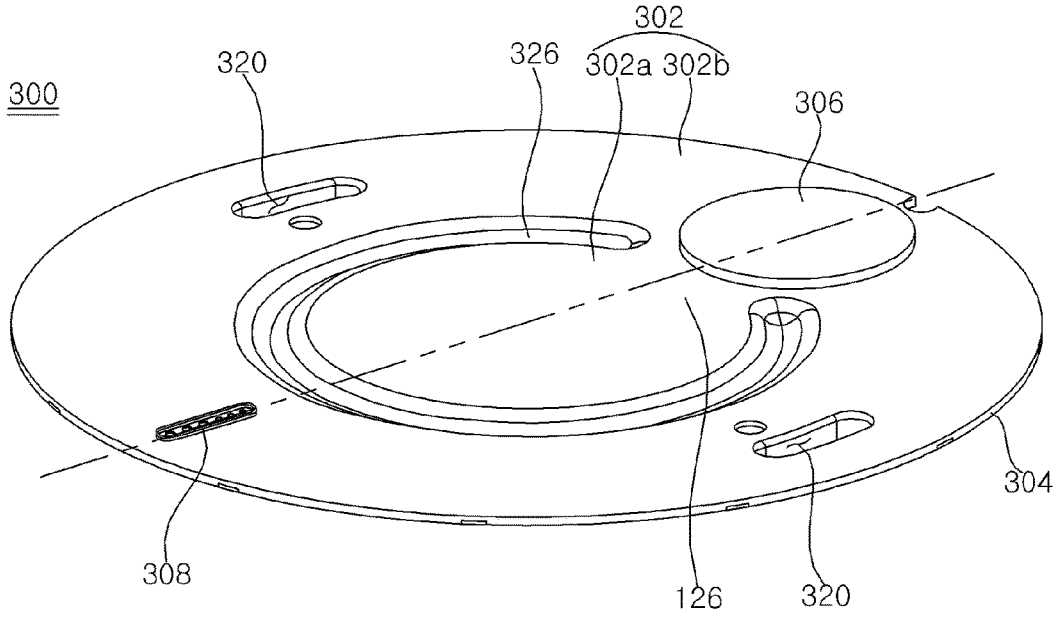
FIG. 9 is a perspective view of an upper cover of an air purifier according to an embodiment of the present disclosure.

The groove 326 may be disposed between the second protruding cover 308 and the first protruding cover 306 and may have a shape recessed downward. The groove 326 may be formed approximately in a ring shape. Referring to FIG. 9, the groove 326 may be formed in a partial ring shape cut or interrupted at a portion of the upper cover 300 where the first protruding cover 306 is disposed.

The plate 302 may have a structure in which a height of a top surface may decrease toward a central portion. The plate 302 may have a structure in which the height of the top surface decreases from a first portion where the first protruding cover 306 is disposed to a second portion where the groove 326 is formed. Thus, a fluid introduced around the first protruding cover 306 may naturally flow downward along the sloped top surface of the plate 302 and into the groove 326.

A through hole 320 through which the fixing holder 260 passes may be formed in the upper cover 300. The through hole 320 is formed in the plate 302. The through hole 320 may be formed in size that allows movement of the fixing holder 260. The fixing holder 260 may extend through the through hole 320 such that an upper portion of the fixing holder 260 may be positioned on the upper side of the upper cover 300. The upper cover 300 may prevent the fixing holder 260 from moving upward as a whole. Thus, the fixing holder 260 movably disposed in the holder hole 244 of the lower cover 210 may fix the top cover 340.

The plate 302 includes a first plate (or first plate region) 302*a* disposed radially inward of the groove 326, and a second plate (or second plate region) 302*b* disposed radially outward of the groove 326. Thus, the groove 326 may divide the plate 302 into a plurality of regions, and water in these regions may flow toward to the groove 326 for collection.

The first protruding cover 306 and the second protruding cover 308 may be spaced apart and protrude upwardly from the plate 302. The first protruding cover 306 and the second protruding cover 308 may be respectively disposed in the mounting hole 344 and the mounting groove 346 of the top cover 340.

A top surface of the first protruding cover 306 may have a shape different from that of a top surface of the second protruding cover 308. The top surface of the first protruding cover 306 may have a different size from that of the top surface of the second protruding cover 308.

A height at which the second protruding cover 308 protrudes upward from the plate 302 may be smaller than a height at which the first protruding cover 306 protrudes upward from the plate 302. As top surface of the first protruding cover 306 may be provided at a same height as a top surface of the top cover 340 so as to form a common surface with the top surface of the top cover 340. The second protruding cover 308 may be formed at a height lower than that of the top surface of the top cover 340, such as to be recessed compared to the top cover 340.

Figure 11:
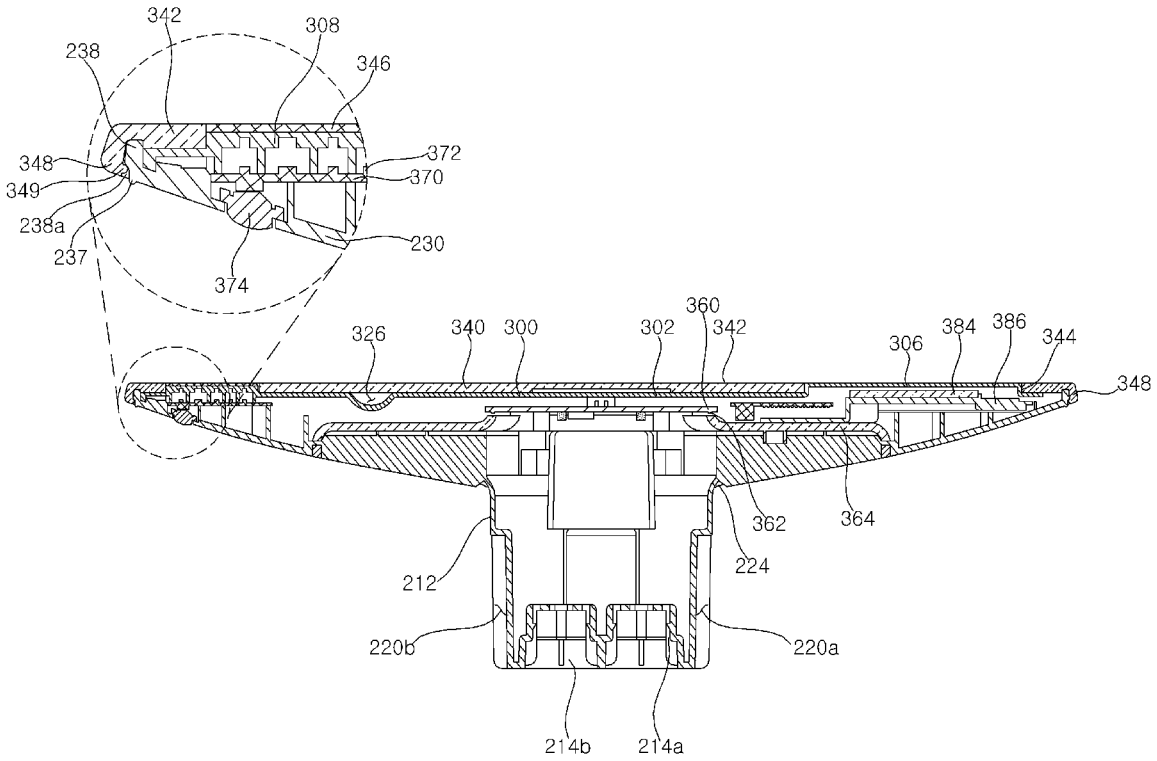
FIG. 11 is a cross-sectional view of a second body of an air purifier taken along line XX' of FIG. 5.
Figure 12:
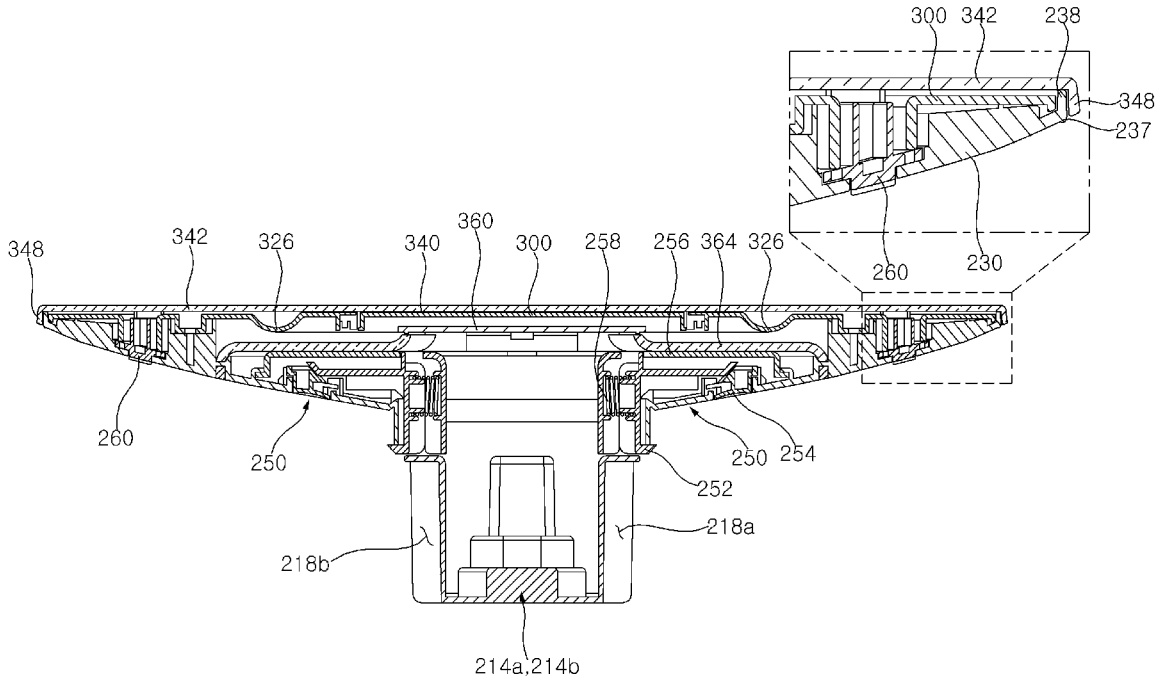
FIG. 12 is a cross-sectional view of a second body of an air purifier taken along line Y-Y' of FIG. 5.

The top cover 340 may be disposed to cover at least a portion of the upper cover 300. The top cover 340 may be disposed on the upper cover 300. Referring to FIGS. 11 and 12, a diameter of the top cover 340 may be larger than a diameter of the top of the lower cover 210. That is, an outer circumferential wall of the top cover 340 may have a structure surrounding the top of the lower cover 210. Accordingly, it may be possible to prevent a fluid flowing outward from the top cover 340 from flowing into the lower cover 210.

The top cover 340 may be formed of a wear-resistant material. The top cover 340 may be formed of a heat-resistant material. For example, top cover 340 may be formed of a wear-resistant and heat resistant PC material or a metal material. A hole corresponding to the protruding cover of the upper cover 300 may be formed in the top cover 340. The mounting hole 344 or mounting groove 346 may be formed in the top cover 340, and the mounting hole 344 and mounting groove 346 may be disposed at a position corresponding to the plurality of protruding covers 306 and 308.

The top cover 340 includes a cover plate 342, and a peripheral wall 348 extending downward from an outer circumference of the cover plate 342. A top surface of the cover plate 342 is formed to be substantially flat. For example, the top surface of the cover plate 342 is formed as a substantially flat surface to function as a tabletop, so that a user can place an object on the top surface of the top cover 340.

The cover plate 342 is formed with the mounting hole 344, where the first protruding cover 306 of the upper cover 300 is disposed, and a mounting groove 346, where the second protruding cover 308 is disposed. The mounting hole 344 may be formed in a shape corresponding to that of the first protruding cover 306. The mounting groove 346 may be formed in a shape corresponding to that of the second protruding cover 308. The mounting hole 344 and the mounting groove 346 may have different shapes corresponding to the different shapes for the first protruding cover 306 and the second protruding cover 308.

The mounting hole 344 and the mounting groove 346 may be disposed on a circumference where a plurality of first corresponding members 352*a* disposed on the top cover 340 may be disposed. The mounting hole 344 and the mounting groove 346 may be disposed on a circumference where a plurality of first magnetic members 328*a* disposed on the upper cover 300 may be disposed. In a state where the top cover 340 is mounted on the upper cover 300, the mounting hole 344 and the mounting groove 346 may be disposed between a plurality of magnetic members 328*a* and 328*b*.

As the first protruding cover 306 is inserted into the mounting hole 344 and the second protruding cover 308 is inserted into the mounting groove 346, the top cover 340 may be placed at a fixed position on the upper cover 300. In a state where the top cover 340 is mounted on the upper cover 300, the top surface of the first protruding cover 306 may form a continuous plane with the cover plate 342 of the top cover 340. In a state where the top cover 340 is mounted on the upper cover 300, the top surface of the second protruding cover 308 may form a continuous plane with the cover plate 342 of the top cover 340. In a state where the top cover 340 is mounted on the upper cover 300, the top surface of the first protruding cover 306 and the top surface of the second protruding cover 308 may combine with a top surface of the top cover 340 to form a substantially flat plane.

In a state where the top cover 340 is mounted on the upper cover 300, the cover plate 342, the first protruding cover 306, and the second protruding cover 308 may form a flat plane as a whole. Here, the state where the top cover 340 is mounted on the upper cover 300 may indicate that the first protruding cover 306 and the second protruding covers 308 are respectively inserted into the mounting hole 344 and a mounting groove 346 of the top cover 340. The state in which the top cover 340 is mounted on the upper cover 300 may further or alternatively indicate that the components 352*a* and 352*b* of the top cover 340 are magnetically coupled to magnetic components 328*a* and 328*b* of the upper cover 300. The state where the top cover 340 is mounted on the upper cover 300 may indicate a state where the top cover 340 is in close contact with the upper cover 300 due to the magnetic members 328*a* and 328*b* being positioned adjacent to the corresponding members 352*a* and 352*b*.

Figure 10:
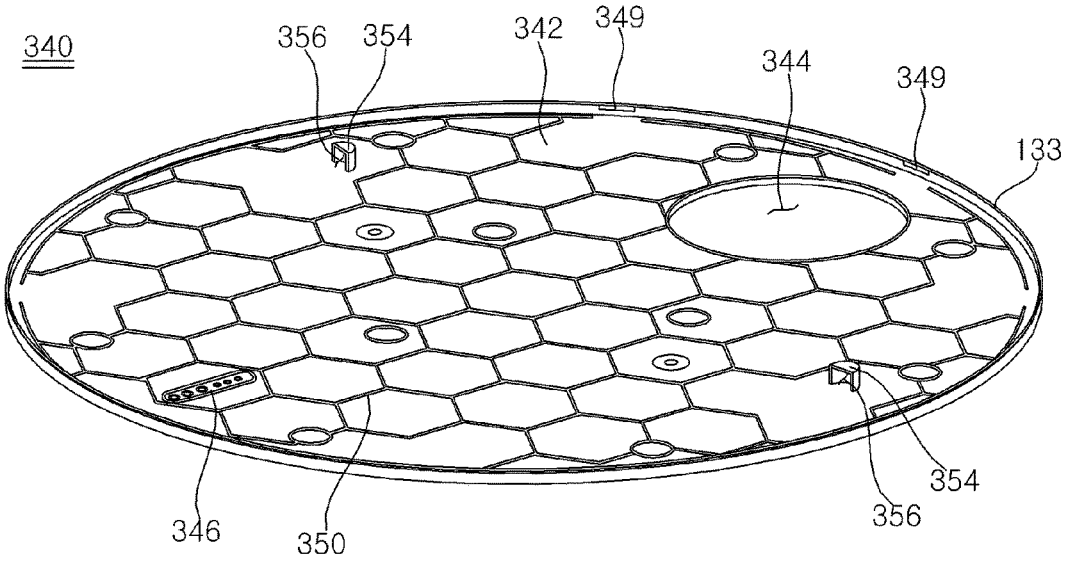
FIG. 10 is a bottom perspective view of a top cover of an air purifier according to an embodiment of the present disclosure.

A plurality of ribs 350 for maintaining the shape of the top cover 340 may be disposed at the top cover 340. The plurality of ribs 350 may be disposed to protrude downward from a bottom surface of the top cover 340. A rib 350 for reinforcing the rigidity of the top cover 340 may be disposed at the bottom surface of the top cover 340. Referring to FIG. 10, each rib 350 may be in a hexagonal shape and protrude downward. It is also possible that each rib 350 may be in a shape different from the example shown in FIG. 10.

A holder cap 354 forming an insertion groove 356 to receive a part of the fixing holder 260 may be disposed at the bottom surface of the top cover 340. The insertion groove 356 may be recessed on one side of a moving direction of the fixing holder 260. Thus, due to the position of the fixing holder 260, a part of the fixing holder 260 may be inserted in the insertion groove 356 or spaced apart from the insertion groove 356.

The peripheral wall 348 may have a structure extending downward from the outer peripheral end of the cover plate 342. The peripheral wall 348 may be disposed radially outward of the edge rib 350 of the lower cover 210. Thus, a fluid flowing down from the top cover 340 may move downward along the peripheral wall 348 of the top cover 340. It may be possible to prevent the fluid flowing down from the top cover 340 from flowing into the lower cover 210.

The outer peripheral end of the peripheral wall 348 may have a shape extending radially outward in a downward direction. A thickness of the peripheral wall 348 may increase in a downward direction.

In the peripheral wall 348 of the top cover 340, an inner protrusion 349 may protrude radially inward from a lower end of the peripheral wall 348. A plurality of inner protrusions 349 may be disposed at the top cover 340. The plurality of inner protrusions 349 may be spaced apart from each other in a circumferential direction. The inner protrusion 349 may be disposed in the fixing groove 238*a* formed in the lower cover 210. Referring to FIGS. 11 and 12, the protruding portion (or protrusion) 237 may be spaced radially inward from the lower end of the peripheral wall 348.

The present disclosure provides an air purifier that enables the use of a space thereabove while efficiently and widely delivering filtered air into an indoor space. The present disclosure also provides an air purifier that prevents liquid or the like spilled on a top of a second body from seeping into a first body. The present disclosure also provides an air purifier that prevents liquids or similar substances entering a second body from entering electrical components of the second body. The aspects of the present disclosure are not limited to the aspects mentioned above, and other aspects not mentioned will be clearly understood by those skilled in the art from the present description.

In one aspect of the present disclosure, there is provided an air purifier including a first body having an inlet formed in a circumferential surface and an outlet formed above the inlet. The air purifier includes: a fan rotatably disposed between the inlet and the outlet to form an air flow from the inlet to the outlet; filter for removing foreign substances in air flowing into the inlet; and a second body disposed above the first body and guiding air discharged from the outlet radially outward. Air filtered through the first body may flow to an outside through the second body.

In addition, the second body may include a lower cover fixedly disposed at the first body and extending radially outward in an upward direction from the outlet to guide the air discharged from the outlet. The second body may include a top cover detachably disposed above the lower cover and forming a flat surface. A protrusion may be formed in a bottom surface of the lower cover and protruding downward, so that liquid spilled on an upper side of the second body does not flow along a guide wall but drips downward via the protrusion.

The protrusion may extend along a circumference from the bottom surface of the lower cover, so that fluid falling downward across an entire surface of the second body can fall outside the first body. The protrusion may protrude radially outward in a downward direction from the lower cover, so that fluid falling downward from the second body can fall outside the first body.

The outlet may be formed in a top surface of the first body, and the protruding portion may be disposed radially apart from an outer circumference of the outlet, so that fluid falling downward from the second body can fall outside the first body. A virtual extension line from a lower end of the protrusion may be positioned radially outward from the outlet, so that fluid falling downward from the second body can drop outside the first body.

The top cover may include a cover plate disposed above the lower cover and a peripheral wall extending downward from an outer circumference of the cover plate, and the peripheral wall may be disposed at an outer circumference of the lower cover, thereby preventing water spilled on the second body from flowing into the second body. The protruding portion may be disposed to be spaced apart radially inward from the peripheral wall.

A thickness of the peripheral wall may increase from an upper side to a lower side, so that liquid flowing along the peripheral wall can fall from a lower end of the peripheral wall to the lower side. The outer peripheral end of the peripheral wall may extend radially outward from an upper side to a lower side, so that liquid flowing along the peripheral wall can fall downward from the lower end of the peripheral wall. An inner protrusion protruding from a lower end of the peripheral wall in a direction where the lower cover is positioned may be disposed inside the top cover, so that the top cover can be mounted on the lower cover.

The lower cover may include an insertion post inserted into the first body. The lower cover may include a guide wall disposed above the insertion post and expanding in diameter in an upward direction. The lower cover may include an edge rib protruding upward from a top of the guide wall. The peripheral wall may be disposed at an outer circumference of the edge rib, preventing water spilled on an upper side of the second body from flowing into the second body. A fixing groove recessed inward to accommodate the inner protrusion may be formed on one side of the edge rib, thereby fixing a position of the top cover.

The second body may include an upper cover disposed between the lower cover and the top cover. A mounting hole into which a part of the upper cover is inserted may be formed in the top cover, so that the top cover can be located at a right position on the lower cover. A groove recessed downward may be disposed on the upper cover, so that liquid entering through the mounting hole can be temporarily collected. The upper cover may have a shape in which a height of a top surface decreases radially inward, so that liquid entering through the mounting hole can be collected in the groove.

According to an air purifier of the present disclosure, there are one or more of the following effects. First, by placing a second body on the upper side of an air purifier that discharges filtered air upward, it is possible to guide the air, discharged through the outlet, in a radial direction, allowing the filtered air to rapidly disperse into an indoor space. In addition, due to a structure in which the second body is coupled to the inside of the first body where an outlet is formed, it is possible to utilize a space above the air purifier.

Second, with a protrusion disposed at a lower cover of the second body, it is possible to prevent liquid flowing along a bottom surface of the lower cover from flowing into a first body. This leads to an advantage of preventing malfunction of a fan rotatably disposed inside the first body. In addition, due to the interconnection between the top cover and the lower cover, as well as the configuration of the edge wall of the top cover, it is possible to prevent liquid spilled on an upper side of the second body from flowing into either the first or the second body.

Third, as a groove is formed in an upper cover of the second body, it is possible to prevent liquid introduced into the second body from flowing into electrical components disposed inside the second body.

Effects of the present disclosure are not limited to the aforementioned effects, and other effects not mentioned will be clearly understood by those skilled in the art from the description of the claims.

Although the present disclosure has been described and illustrated with exemplary embodiments, the present disclosure is not limited thereto, but may be variously modified and altered by those skilled in the art to which the present disclosure pertains without departing from the subject matters of the present disclosure claimed in the following claims. These modifications or alterations should not be appreciated individually from the technical spirit or prospect of the present disclosure.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element (s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An air purifier comprising:

a first body having an inlet, an outlet formed above the inlet, and a fan configured to form an air flow from the inlet to the outlet; and a second body provided above the first body, wherein the second body includes:

a first cover coupled to the first body and including a bottom surface that extends radially outward in an upward direction from the outlet to guide air discharged from the outlet; and a second cover detachably provided above the first cover and forming a flat upper surface of the second body, wherein a protrusion extending downward is formed in the bottom surface of the first cover, and wherein:

the outlet is formed in a top surface of the first body, and the protrusion is spaced apart radially from an outer circumference of the outlet.

2. The air purifier of claim 1, wherein the protrusion extends along the bottom surface of the first cover in a circumferential direction.

3. The air purifier of claim 1, wherein the protrusion protrudes radially outward and downward from the first cover.

4. The air purifier of claim 1, wherein a lower end of the protrusion is positioned radially outward from the outlet.

5. The air purifier of claim 1, wherein:

the second cover includes a cover plate positioned above the first cover, and a peripheral wall extending downward from an outer circumference of the cover plate, and the peripheral wall is provided at an outer circumference of the first cover.

6. The air purifier of claim 5, wherein the protrusion is spaced radially inward from the peripheral wall.

7. The air purifier of claim 5, wherein a thickness of the peripheral wall increases from an upper side of the peripheral wall to a lower side of the peripheral wall.

8. The air purifier of claim 5, wherein the peripheral wall extends radially outward between an upper side of the peripheral wall to a lower side of the peripheral wall.

9. The air purifier of claim 5, wherein the second cover includes an inner protrusion protruding from a lower end of the peripheral wall and in a direction toward the first cover.

10. The air purifier of claim 9, wherein:

the first cover includes:

an insertion post configured to be inserted into the first body;

a guide wall positioned above the insertion post and extending outward from the insertion post in an upward direction to define the bottom surface of the first cover; and an edge rib protruding upward from a perimeter of the guide wall, and the peripheral wall is provided at an outer circumference of the edge rib.

11. The air purifier of claim 10, wherein a fixing groove recessed inward and configured to accommodate the inner protrusion is formed on a side of the edge rib.

12. The air purifier of claim 1, wherein:

the second body includes a third cover provided between the first cover and the second cover, and a mounting hole into which a part of the third cover is inserted is formed in the second cover.

13. The air purifier of claim 12, wherein a groove recessed downward and configured to receive a liquid is provided in the third cover.

14. The air purifier of claim 13, wherein a height of a top surface of the third cover decreases radially inward.

15. The air purifier of claim 1, wherein:

the first cover includes a button that is provided on the bottom surface of the first cover, and the protrusion is positioned between the button and a perimeter of the first cover.

16. The air purifier of claim 1, wherein:

the first cover includes a latch that is configured to be movable by a user to selectively couple the first cover and the second cover, and the protrusion is positioned between the outlet and the latch.

17. The air purifier of claim 1, wherein:

the first cover includes a latch that is configured to be movable by a user to selectively couple the first cover and the second cover, and the protrusion is positioned between the latch and a perimeter of the first cover.

* * * * *